United States Patent [19]

Campbell

[11] Patent Number: 4,648,506

[45] Date of Patent: Mar. 10, 1987

[54] PACKAGE WITH SPREADER FOR SPREADABLE MATERIAL

[75] Inventor: Rolf W. J. Campbell, Minneapolis, Minn.

[73] Assignee: Land O'Lakes, Inc., Minneapolis, Minn.

[21] Appl. No.: 843,262

[22] Filed: Mar. 24, 1986

Related U.S. Application Data

[63] Continuation-in-part of Ser. No. 773,047, Sep. 6, 1985, abandoned.

[51] Int. Cl.[4] ..... B65D 47/10; B65D 85/74

[52] U.S. Cl. ..... 206/216; 206/229; 206/461; 206/469; 401/132; 401/139; 401/266; 426/115; 426/130

[58] Field of Search ..... 206/219, 216, 461, 469, 206/471, 530, 553, 812; 426/115, 130; 401/132, 139, 266

[56] References Cited

U.S. PATENT DOCUMENTS

| | | | |
|---|---|---|---|
| 1,860,790 | 5/1932 | Schultheiss | 401/266 |
| 2,021,653 | 11/1935 | Johnson | 401/266 |
| 3,369,267 | 2/1968 | Friedland | 206/216 |
| 3,891,085 | 6/1975 | Boger | 206/229 |
| 4,127,339 | 11/1978 | Malacheski et al. | 401/132 |
| 4,218,155 | 8/1980 | Weidner | 401/132 |

*Primary Examiner*—William Price
*Assistant Examiner*—Brenda J. Ehrhardt
*Attorney, Agent, or Firm*—Kinney & Lange

[57] ABSTRACT

A package with spreader is hermetically sealed for storing relatively stiff spreadable materials such as butter until ready for use. The package includes a base having a relatively stiff spreader blade partially defined by a blade spread side surface and an opposed base supply side. The base also includes a deformable blister for holding the spreadable material. The blister is open through the blade to its spread side surface and extends outwardly from the blade on the supply side of the base. A peelable membrane initially seals the butter inside of the blister by being in sealing relation to the spread side surface of the blade. A portion of the membrane is manually peelable from sealing relation with respect to part of the blade and uncovers a portion of the blister to provide a butter delivery opening through which the butter can be forced by digital pressure on the outside of the blister. The butter can then be immediately spread using the sealing side surface of the blade.

19 Claims, 10 Drawing Figures

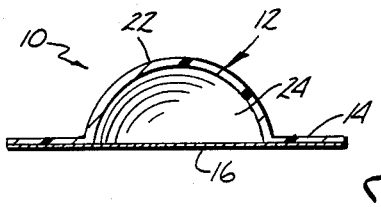
Fig. 6
Fig. 7
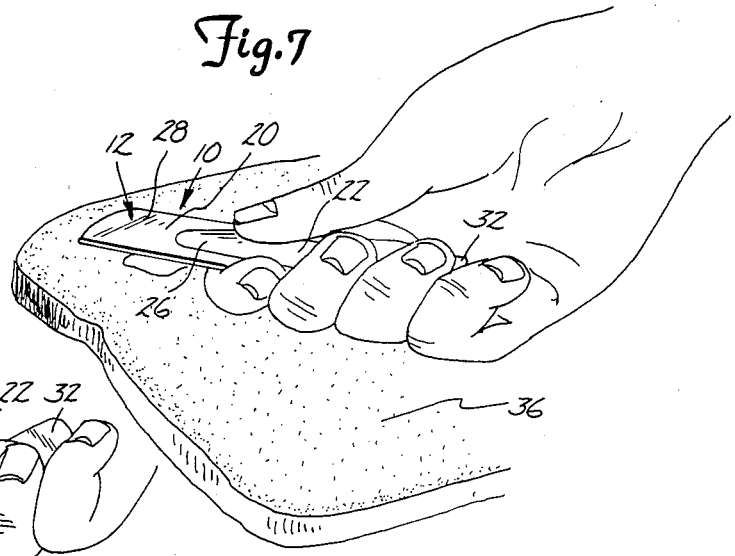
Fig. 8
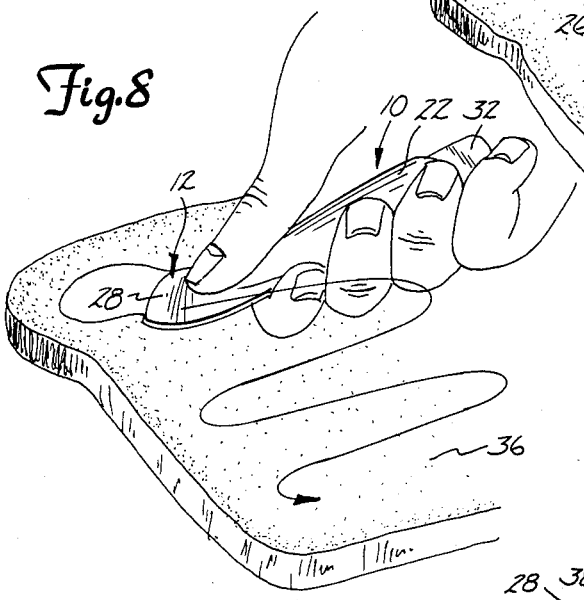
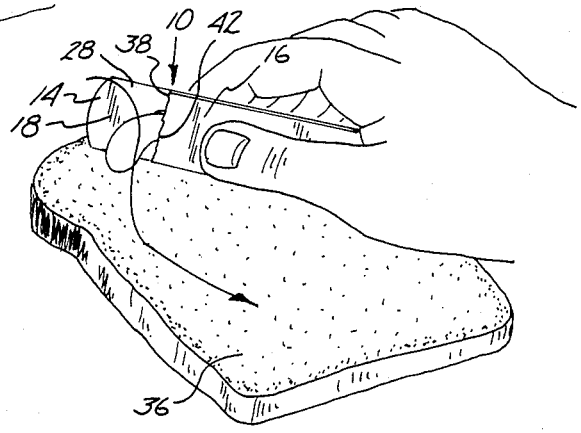
Fig. 9

PACKAGE WITH SPREADER FOR SPREADABLE MATERIAL

This is a continuation-in-part of application Ser. No. 06,773,047, filed Sept. 6, 1985 abandoned.

BACKGROUND OF THE INVENTION

1. Field of the Invention:

This invention has relation to packages for individual servings of spreadable materials such as butter or margarine and to a structure which will keep the material in a sealed pocket until it is ready for use and then will permit the material to be manually discharged from the pocket at a controlled rate as needed and will serve as a spreader for such material.

2. Description of the Prior Art:

Individual containers are used in restaurants for dispensing individual portions of liquid coffee whitener, and spreadable materials such as butter and ketchup. Many of these containers are cup-shape and utilize peelable membranes to hermetically seal their contents until the contents are to be used. See, for example, U.S. Pat. No. 3,069,273 to Wayne, granted in December of 1962; U.S. Pat. No. 3,660,960 to Inman, granted in May of 1972; U.S. Pat. No. 2,705,579 to Mason, granted in April of 1955; U.S. Pat. No. 4,384,649 to Brodsky, granted in May of 1983; U.S. Pat. No. 4,369,885 to Redmond, granted in January of 1983; and French Pat. No. 1,488,333 delivered in June of 1967.

Individual dispenser packages made of heat sealable sheets for holding ketchup or the like, and which must be cut or torn to release the contents are shown in U.S. Pat. No. 3,315,801 to Lowry, granted in April of 1967.

A package consisitng of two compartment walls of heat sealable, flexible material adapted to contain an easily spreadable material such as ketchup is shown in U.S. Pat. No. 3,453,661 to Repko, granted in July of 1969. This patent shows a stiffener adhered to one wall to keep the package from bending while the ketchup is being dispensed. The stiffener extends from end to end of the package, is located on the centerline of the package, and the inventor states that, "In a preferred embodiment . . . the stiffener is narrower than the" flexible walls. Specification, column 2, beginning on line 43. Further in the specification, column 3, beginning on line 45, Repko states that the spreadable material or ketchup, after the package is opened, is "then spread evenly on the surface of the hamburger. During this operation, the stiffener 24 adds the desired support to the package 20, thus precluding the collapse of the package 20 and insuring even, effortless spreading of the material 35 to form a uniform coating."

What was needed before the present invention was a package which furnished its own stiffness, and provided for the dispensing at a controlled rate of a fairly firm spreadable material such as butter onto a butterknife-like spreader blade, the entire surface of which is kept free of contaminants until the package with spreader is put into use dispensing and spreading the spreadable material. Such a package should be so designed and shaped as to allow virtually all of the spreadable material to be easily evacuated from it.

A number of additional patents were found by searchers for this invention; but none is believed to disclose anything more pertinent than those patents discussed above.

Neither the inventor nor those in privity with him are aware of any closer prior art than that discussed above, and they are not presently aware of any prior art which negates the patentability of the claims herein.

SUMMARY OF THE INVENTION

A package and spreader unit for spreadable material includes a base of sheet material having:

(1) an elongate, relatively stiff planar blade partially defined by a blade spread side surface and a supply side of the base, the blade having a delivery end portion and a handle end portion; and (2) a deformable blister to hold a spreadable material such as butter or margarine, the blister being part of the supply side of the base and being open through the blade and extending outwardly from it on the supply side of the blade. With the spreadable material in a pocket defined by the interior of the blister, a flat membrane initially seals off the pocket and is sealed to the spread side surface of the blade.

At least a first portion of the membrane adjacent the delivery end portion of the blade and in underlying relation to a portion of the blister immediately adjacent the blade delivery end portion is manually peelable from sealing relation with respect to the blade, this first portion of the membrane being frangible and being removable from a second remaining sealed portion of the membrane. Means is provided for predetermining the size and shape of the first peelable portion of the membrane which will be manually removed from the second remaining sealed portion of the membrane to provide an opening through which the spreadable material can be dispensed by action of the user's thumb or fingers on the outside of the blister.

BRIEF DESCRIPTION OF THE DRAWINGS

FIG. 6 is a transverse vertical sectional view taken on the line 6—6 in FIG. 4;

FIG. 7 is a perspective view of the package and spreader unit of the invention as seen in FIG. 5 in the hand of a user of the unit while in the act of expelling butter or other spreadable material from the unit preparatory to spreading it on bread or toast or other position for use;

FIG. 8 is a perspective view of the unit of FIG. 7 as it might appear in the hand of a user when the thumb had reached the end of its travel to expel spreadable material from the unit together with a diagrammatic illustration of the pattern that the user might employ in using the blade in spreading the spreadable material on bread or toast;

FIG. 9 is a perspective view of the unit of the invention in the right hand of a user as that user might initially hold the unit over bread to be spread while expelling the spreadable material from the unit and observing its delivery onto the bread.

DETAILED DESCRIPTION OF THE PREFERRED EMBODIMENTS

Figure 1:
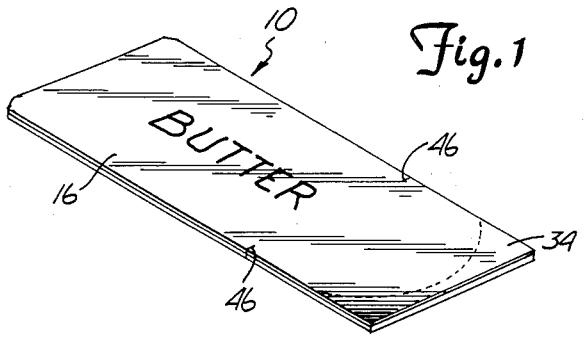
FIG. 1 is a perspective view of a package and spreader unit of a first form of the present invention with a spread side of the unit uppermost.

In a first form of the invention as shown, a package and spreader unit 10 includes a base 12 having a unitary, flexible, relatively stiff, elongate, planar blade 14 and a planar membrane 16 initially in sealing relation to the blade 14.

The blade 14 is partially defined by a spread side surface 18 and an opposed spaced-apart supply side 20 of the base 12.

The base 12 also includes a demiegg-shaped deformable spreadable material-encompassing blister 22 integral with and open to and through the blade 14 and extending outwardly from the blade on the supply side thereof. The blister 22 forms part of the supply side of the base 12. The base can be made of any one or more of a number of different suitable materials, but a 12 mil polystyrene sheet molded by the vacuum-forming process has been found to be satisfactory for the purpose.

Figure 3:
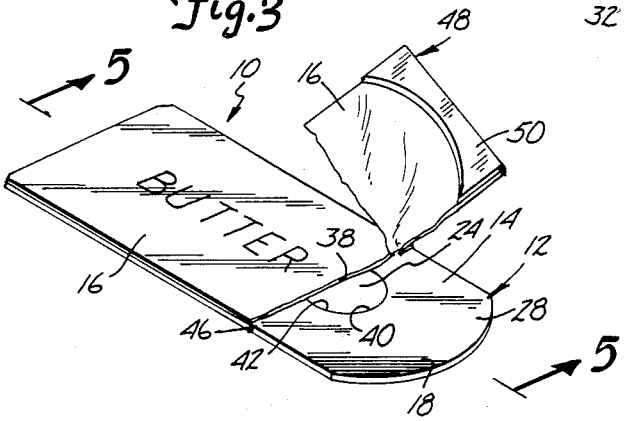
FIG. 3 is a perspective view of the package and spreader unit as seen in FIG. 1 but showing a first portion of a closure membrane being removed therefrom to create a spreadable material delivery opening.

Once the base 12 has been created, a spreadable material such as butter, margarine, jelly, ketchup, artists oil paint, putty, caulking compound, medicinal ointments or the like will be introduced into a pocket 24 defined by the blister 22 when the spread side of the base is uppermost as suggested in FIG. 3, for example, This can either be done with individual units 10, or can be done when spaced-apart, individual blisters 22 have been formed in a much larger sheet as a step in making a large number of individual units. Whether individually or in a large sheet with many other as yet undivided individual units, after the spreadable material of choice is in place, a relatively thin, freely bendable, planar membrane 16 will be sealed over the entire spread side of the base 12.

Membrane 16 can be made of any one of a large number of suitable materials. A frangible or easily rupturable aluminum foil laminate covered on one surface with a poly based, peelable, thermoplastic adhesive has been found satisfactory for the purpose.

For ease of understanding and illustration, the "thickness" dimension of the materials has been somewhat exaggerated in the drawings.

The demiegg-shaped blister 22 has a narrow end portion 26 adjacent a rounded delivery end portion 28 of the blade 14, while a wide end portion 30 of the blister is located adjacent a handle end portion 32 of the blade.

As best seen in FIG. 1, a portion 34 of the membrane 16 overhangs the rounded delivery end portion 28 of the blade 14 when the unit is positioned as pictured in FIG. 1. This extension of the membrane beyond the blade is for the purpose of allowing the user of the package and spreader unit 10 to grasp the overhanging portion 34 of the membrane with the thumb and finger of one hand while holding the remainder of the package and spreader unit 10 in the other and then tearing a portion of the membrane back and away from the spread side surface 18 of the blade 14 through the position as seen in FIG. 3 to remove it and overhanging portion 34 from the balance of the unit. The unit is then ready for use to deliver the spreadable material and to spread that material on an appropriate substrate such as, for example, a piece of bread or toast 36.

Means is provided to limit the size and shape of that portion of the membrane 16 which will be torn off and discarded to that illustrated in FIG. 3. As best seen in that figure, a remaining torn edge 38 of the remaining portion of membrane 16 and an uncovered portion 40 of the periphery of the junction of the blade 14 and the blister 22 define a spreadable material delivery opening 42 of size and shape to suitably accommodate the delivery of a particular spreadable material from the pocket 24 defined by the blister 22.

The demiegg-shape of the blister 22, with narrow end portions 26 open to delivery opening 42, is effective to allow a user to very easily completely empty the material from pocket 24 by simple digital pressure from wide end portion 30 toward narrow end portion 28 of the blister.

Figure 2:
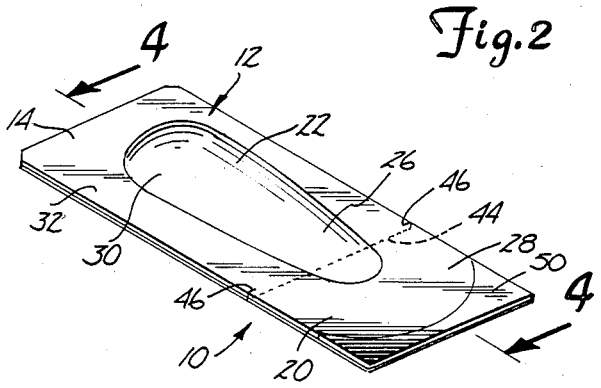
FIG. 2 is a perspective view of the unit of FIG. 1 with a supply side of the unit uppermost.

A number of different means could be used to insure that the area and shape of the torn away portion of the membrane is as desired. For example, (1) the membrane can be scored to provide a weakness along the line of the desired position of the remaining torn edge 38 as indicated at 44 in FIG. 2;

(2) the aluminum foil laminate from which the membrane is made can be manufactured to have easy tearability along paths parallel to and coincident with line 44; or (3) the portion of the membrane which is to remain can be printed along line 44 in a color in contrast to the color of the portion to be torn off.

In the preferred form, as shown best in FIG. 1, however, a pair of slits 46,46 are provided in the outer edges of the membrane 16. These slits stop far short of the periphery of the junction of the blister with the blade, so they do not affect the initial effective seal of the membrane with respect to the blade to hold the spreadable material within the pocket 24. With these cuts or slits 46 in place, the person using the unit can hold the bulk of the unit in his left hand, and, for example, grasp the overhanging portion 34 at the position as indicated at 48 in FIG. 3 and pull up and across the unit in direction from one slit 46 toward the outer thus leaving the remaining torn edge 38 as seen in FIG. 3 to help define the delivery opening 42.

Figure 4:
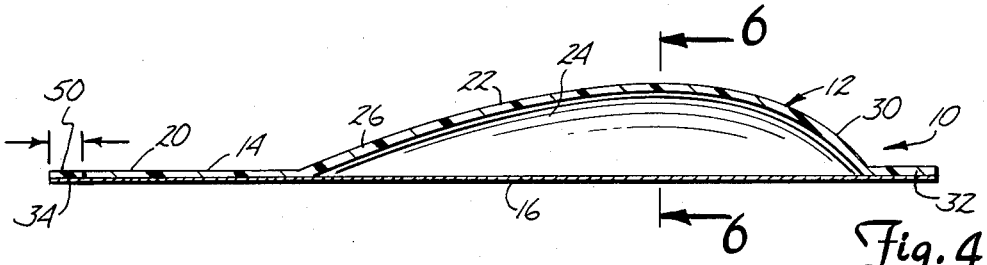
FIG. 4 is an enlarged vertical sectional view taken on the line 4—4 in FIG. 2.

To make the tearing away of the frangible membrane 16 even easier, an extension 50 of the unitary blade 14 is left in place during the manufacturing operation. Initally this extension can be part of the blade 14, but at any appropriate point in the manufacture of the device, it can be severed to define the rounded delivery portion 28 of the blade. As clearly seen in FIGS. 2 and 3, this may best be done after the unitary blade 14 and the blade extension 50 have been firmly bonded to the membrane 16 and to the overhanging portion 34 of the membrane 16, respectively. This severing of the extension 50 from the blade 14 can be done in any usual or preferred manner, forming no part of the invention per se. For example, extension 50 can be die cut from the blade 14 at the time a large number of individual units 10 are separated from each other by a similar process. The extension 50 is shown in FIG. 4 as being completely cut from the blade; but a cut of 70% through the polystyrene sheet, which will break off as soon as the extension 50 is bent up with respect to the blade 14, will prove quite satisfactory.

The extension 50, being bonded to the overhanging portion 34 of the membrane 16, makes it much easier to control the severable portion of the membrane as it is being removed. Blade extension 50 and overhanging portion 34 are grasped by a thumb and finger of the user and removed from the rest of the unit as illustrated in FIG. 3.

Figure 5:
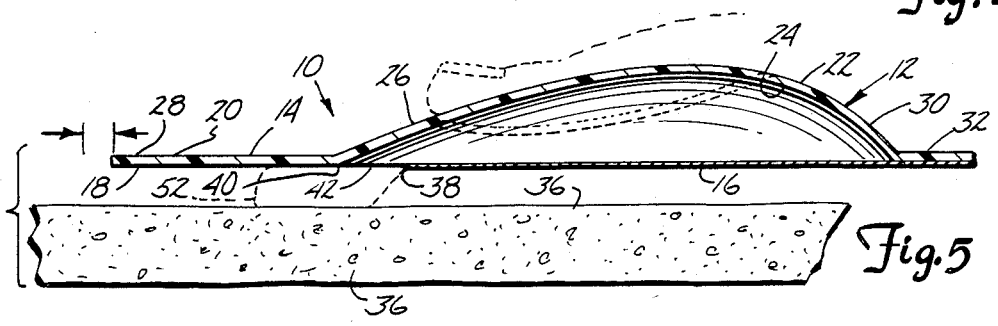
FIG. 5 is an enlarged inverted vertical sectional view taken on the line 5—5 in FIG. 3 but with a portion of the membrane removed preparatory to using the unit to deliver and spread spreadable material.

In FIG. 1, the unit is seen in position to be opened for use. The user will grasp the severed blade extension 50 and the overhanging portion 34 of the membrane 16 in the fingers and thumb of one hand, will hold the rest of the unit in the other hand, and will tear off the frangible or rupturable portion of the membrane as illustrated in FIG. 3 to arrive at the structure as seen in inverted position in FIG. 5. Holding the unit in one hand, the thumb, for example, can be forced down against the deformable blister 22 as seen in dotted lines to force a spreadable material such as butter to extrude through the delivery opening 42 to a position as represented by dotted line 52 toward the surface of a piece of bread 36, for example.

The narrow end portion 26 of the blister 22, with its uncovered intersection 40 with blade 14 and with the remaining torn edge 38 of the membrane 16, forms the spreadable material delivery opening 42 which permits a relatively narrow ribbon of extruded spreadable material such as butter to be delivered exactly where it is wanted onto the blade 14 and on the site where the material is to be spread. The wide end portion 30 of the blister is also deeper than the narrow end portion 26 and so provides for a greater volume of spreadable material to be encompassed by the blister 22. These end portions join to form the demiegg-shape blister 22 which permits the user of the unit to eventually expel virtually all of the butter, for example, from the blister. This is done by finally using a thumb or fingers to compress the blister down against the membrane, working from the wide end toward the narrow end. Since all of the material has to pass through the relatively narrow spreadable material delivery opening 42, it all is dispensed in the same narrow ribbon of material which was initially extruded through that opening. In addition to the accuracy of delivery, this narrow opening on the relatively wide blade also makes it possible for the user to dispense the butter or other spreadable material and to spread it with little if any chance of getting such materials on the hands or elsewhere on the person.

Various versions of the process of using the unit are illustrated in FIGS. 7, 8 and 9. These figures show or suggest the versatility of the unit to dispense butter, for example, only as needed, to spread the dispensed butter using the spread side surface 18 of the blade 14, and then to dispense and spread more butter on the same piece of bread or on the next piece to be buttered. Butter not used on one piece of bread remains within the pocket 24 of the blister 22 until such a time as the user again manually deforms the blister to expel more of it.

Delivery and spread of the spreadable material from the unit will be accomplished at the very least under clean conditions as the spread side surface of the blade will remain covered by the heat sensitive side of the membrane until the unit is ready to be opened for use. Where the spreadable material must be applied under sterile conditions, as in the case of applying medicinal ointments, for example, the spread side surface 18 of the blade 14 can be initially sterilized by the process of heat sealing the membrane to the blade, or otherwise. With the peeling of a portion of the membrane away from the rest of the unit to form the spreadable material delivery opening 42, the material dispensed therefrom and the spreader side surface 18 of the blade 14, will not contaminate a sterile surface on which the material is spread.

Since the blister 22 is vacuum-formed from a flat sheet of uniform thickness, it is substantially thinner than the blade 14. Because of this and because of its dome shape, the blister 22 can easily be dented by application of the thumb or fingers of the hand of the user to it to controllably expel relatively stiff but spreadable butter and margarine therefrom. At the same time, a blade 14 will be of sufficient stiffness to effectively spread such butter or margarine.

Since the package and spreader unit of the invention is designed to be disposable, however, it is highly advantageous to make the base using as little plastic material as possible while still achieving the advantages of the invention. This can be done by constituting most of the base of a thinner material. In order to enhance the stiffness of the delivery end portion of the blade 14, the polystyrene sheet from which the base is formed can be of various thicknesses. For example, by extruding the sheet in perpendicular direction with respect to the longitudinal axis of the blade and of the blister, the sheet can be constituted so that the base formed from it can, after being vacuum-formed, have a rounded blade delivery end portion 28 (and perhaps even some of a forward-most part of the narrow end portion 26 of the blister 22) thicker, and therefore stiffer, than the remainder of the base.

A stiffer delivery portion of the blade can also be achieved by providing parallel, spaced-apart, longitudinal ridges extending integrally upwardly of the blade 14 from the supply side of the base 12; or by corrugating the blade along such parallel longitudinal lines.

As an aid to removing the membrane 16 from sealing relation with respect to the spread side surface 18 of the blade 14, a first portion of the membane can be heat sealed to the blade over less than the entire contiguous area of the first portion of the membrane and the spread side surface of the blade. This can be done by shaping a hot iron or anvil to contact the membrane during the sealing operation only at the precise areas where sealing is to occur.

Figure 10:
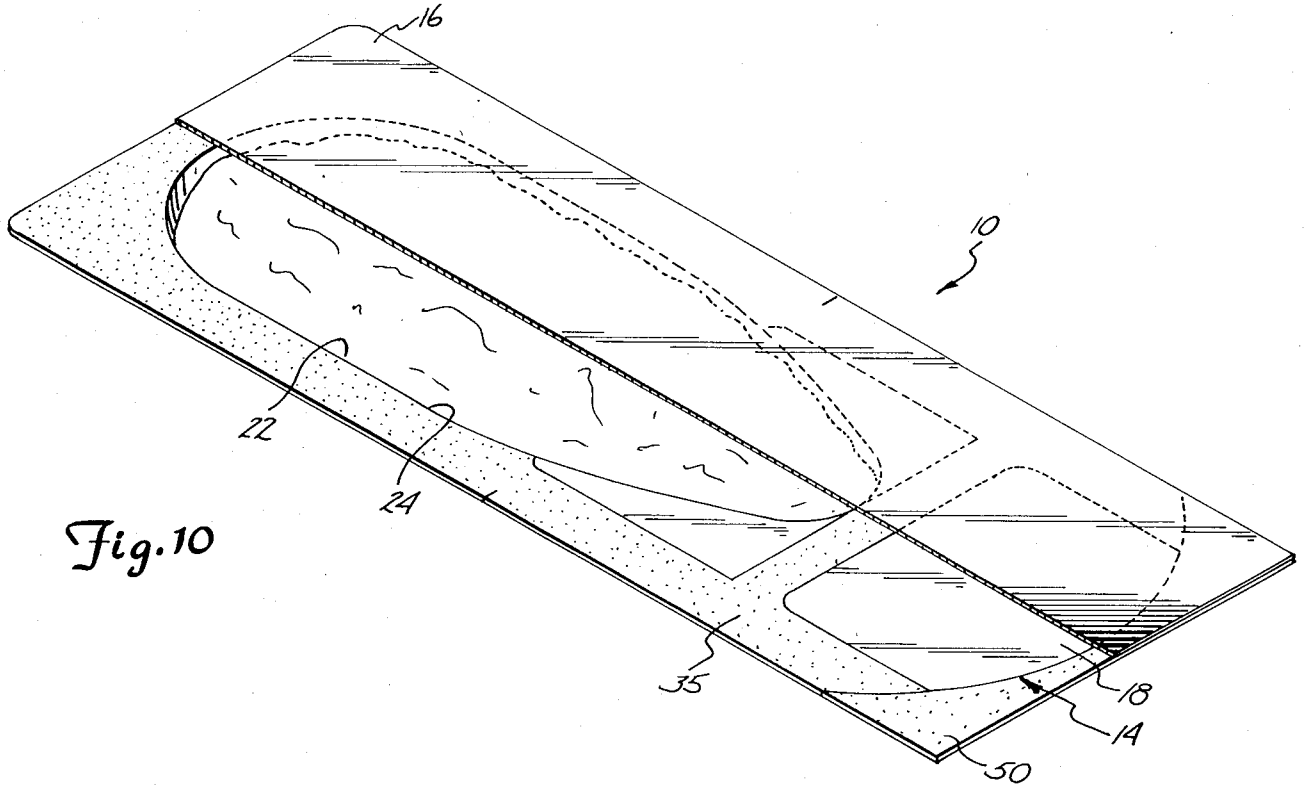
FIG. 10 is a perspective view of a package and spreader unit of a second form of the invention with one-half of a closure membrane omitted to show in phantom one pattern for sealing the closure membrane to the spread side of a planar blade of the unit.

An example of an area which can be sealed to permit easier later removal of the first portion of the membrane from the blade 14 is illustrated in FIG. 10. In that figure, an area 35 of the spread side surface 18 of the blade which was heat sealed to the membrane is shaded where the membrane 16 bas been omitted and the outlines of this area 45 are shown in dotted lines through that portion of the membrane which is shown in full.

Although the present invention has been described with reference to preferred embodiments, workers skilled in the art will recognize that changes may be made in form and detail without departing from the spirit and scope of the invention.

What is claimed is:

1. A package and spreader unit for spreadable material including:

A. a base of sheet material having:

(1) an elongate, relatively stiff, planar blade partially defined by a blade spread side surface and an opposed spaced-apart supply side of the base, said blade having a forward delivery end portion and a rearward handle end portion, and (2) a deformable blister adapted to initially encompass spreadable material, said blister being part of the supply side of the base and being open through said blade and extending outwardly from it on the supply side of the base;

B. a planar membrane initially overlying the opening of the blister through the blade in sealing relation to the spread side surface of the blade around the blister to form a closed receptacle for the spreadable material, a first portion of said membrane adjacent the blade delivery end portion and in underlying relation to a portion of said blister immediately adjacent said blade delivery end portion being manually peelable from sealing relation with respect to said blade, and being frangible and removable from said blade and separable from a second remaining sealed portion of the membrane to provide an outlet for the spreadable material to the spread side surface of the blade.

2. The package and spreader unit of claim 1, and:

C. means for predetermining the size and shape of the first peelable portion of the membrane which can be manually removed from the second remaining sealed portion of the membrane.

3. The package and spreader unit of claim 1 wherein:

C. a third portion of the membrane is integral with the first portion and is not initially in sealed relation with respect to the blade to facilitate removal of the first portion of the membrane.

4. The package and spreader unit of claim 3 wherein:

D. the third portion of the membrane is initially in overhanging relation with respect to the blade.

5. The package and spreader unit of claim 4 wherein:

E. the third portion of the membrane extends forwardly of the delivery end portion of the blade; and F. a finger grip is provided forwardly of the blade, said finger grip being in fixed relation to the thrid portion of the membrane.

6. The package and spreader unit of claim 5 wherein:

G. said finger grip extends forwardly of the blade and is manually movable away from the blade by movement of it and the third portion of the membrane in direction away from the supply side surface of the blade.

7. The package and spreader unit of claim 1 wherein:

C. the base is made of a polystyrene sheet; and

D. the membrane includes an aluminum foil laminate covered on one side surface with a poly based thermoplastic adhesive.

8. The package and spreader unit of claim 6 wherein:

H. the base is made of a polystyrene sheet; and

I. the membrane includes an aluminum foil laminate covered on one side surface with a poly based thermoplastic adhesive.

9. The package and spreader unit of claim 1 wherein:

C. the blister has a wider and deeper portion adjacent the handle end portion of the blade and a narrower and shallower portion adjacent the delivery end portion of the blade.

10. The package and spreader of claim 9 wherein:

D. the blister has a demiegg shape.

11. The package and spreader unit of claim 2 wherein:

D. the means for predetermining the size and shape of the first peelable portion of the membrane includes a pair of slits in the outer edges of the membrane at the ends of a preferred line of separation of the first manually peelable portion from the second remaining portion of the membrane.

12. The package and spreader unit of claim 2 wherein:

D. the means for predetermining the size and shape of the first peelable portion of the membrane includes a line of weakness in the membrane from edge to edge defining a predetermined line of separation of the first manually peelable portion from the second remaining portion of the membrane.

13. The package and spreader unit of claim 2 wherein:

D. the means for predetermining the size and shape of the first peelable portion of the membrane includes a line of visually perceptible contrast in the membrane separating the first manually peelable portion from the second remaining portion of the membrane.

14. The package and spreader of claim 1 wherein:

C. the planar membrane initially overlying the opening of the blister through the blade is in sealing relation to the spread side surface of the blade around the complete periphery of the junction of the blister with the blade.

15. The package and spreader of claim 1 wherein:

C. the planar membrane initially overlying the opening of the blister through the blade is in sealing relation to the spread side surface of the blade in spaced relation to at least a portion of the line of junction between the blister and the blade.

16. The package and spreader of claim 15 wherein:

D. that portion of the membrane which is in sealing relation to the blade in spaced relationship with respect to the line of junction of the blister with the blade is part of the peelable first portion of the membrane.

17. The package and spreader of claim 1 wherein:

C. substantially less than all of the first portion of the membrane is initially in sealing relation to the blade.

18. The package and spreader of claim 17 wherein:

D. substantially all of the second portion of the membrane is in sealing relation to the blade.

19. The package and spreader of claim 1 wherein:

C. substantially all of the second portion of the membrane is in sealing relation to the blade.

* * * * *